US010507659B2

(12) United States Patent
Wang

(10) Patent No.: US 10,507,659 B2
(45) Date of Patent: Dec. 17, 2019

(54) LIQUID JETTING HEAD AND INK-JET PRINTER

(71) Applicant: Brother Kogyo Kabushiki Kaisha, Nagoya-shi, Aichi-ken (JP)

(72) Inventor: Rui Wang, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/193,320

(22) Filed: Nov. 16, 2018

(65) Prior Publication Data

US 2019/0291426 A1 Sep. 26, 2019

(30) Foreign Application Priority Data

Mar. 23, 2018 (JP) ..... 2018-056902

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ... B41J 2/1433; B41J 2/14233; B41J 2/14209
USPC ..... 347/20, 50, 54, 57, 58
See application file for complete search history.

(56) References Cited

U.S. PATENT DOCUMENTS

| | | | | |
|---|---|---|---|---|
| 7,621,622 | B2 * | 11/2009 | Kachi | B41J 2/14233 347/50 |
| 8,136,927 | B2 * | 3/2012 | Kondo | B41J 2/14233 347/50 |
| 9,393,785 | B2 * | 7/2016 | Kinoshita | B41J 2/055 |
| 9,889,655 | B2 * | 2/2018 | Tanaka | B41J 2/14233 |
| 2006/0209138 | A1 | 9/2006 | Kachi | |
| 2014/0292936 | A1 | 10/2014 | Kinoshita et al. | |

FOREIGN PATENT DOCUMENTS

| | | | |
|---|---|---|---|
| JP | 2003-062998 | A | 3/2003 |
| JP | 2006-289963 | A | 10/2006 |
| JP | 2017-222182 | A | 12/2017 |

* cited by examiner

*Primary Examiner* — An H Do
(74) *Attorney, Agent, or Firm* — Banner & Witcoff, Ltd.

(57) ABSTRACT

A liquid jetting head includes: a nozzle plate having a nozzle surface in which nozzles are open; a channel member having a first surface and a second surface on an opposite side to the first surface, the nozzle plate being joined to the first surface, the channel member being formed with channels communicating with the nozzles respectively and a cavity being different from the channels, the channels including pressure chambers respectively; drive elements provided on the second surface of the channel member to correspond to the pressure chambers respectively, the drive elements having terminals led out to the second surface of the channel member; and a wiring member having wirings, the wirings being joined to the terminals respectively on the second surface of the channel member.

18 Claims, 7 Drawing Sheets

LIQUID JETTING HEAD AND INK-JET PRINTER

CROSS REFERENCE TO RELATED APPLICATION

The present application claims priority from Japanese Patent Application No. 2018-056902 filed on Mar. 23, 2018, the disclosure of which is incorporated herein by reference in its entirety.

BACKGROUND

Field of the Invention

The present invention relates to a liquid jetting head and an ink-jet printer including the liquid jetting head.

Description of the Related Art

From the past, there is known a liquid jetting head that includes: a channel substrate having liquid channels formed therein; piezoelectric elements provided to the channel substrate to correspond to the liquid channels; and a wiring member equipped with a driver IC. The driver IC outputs a drive signal for driving each of the piezoelectric elements. A conventional liquid jetting head includes: individual electrodes that are individually provided to the piezoelectric elements; and a common electrode provided commonly to the piezoelectric elements. The respective individual electrodes are electrically connected to individual electrode terminals led out to a surface, of the channel substrate, on which the piezoelectric elements are provided. Moreover, the common electrode is electrically connected to a common electrode terminal led out to the surface, of the channel substrate, on which the piezoelectric elements are provided. By the wiring member being joined by an adhesive (resin) to the channel substrate, the individual electrode terminals and the common electrode terminal are electrically connected to wiring terminals of the wiring member.

Incidentally, for an industrial ink-jet printer, an ink having a high viscosity at room temperature is sometimes used. There is known a method for jetting the ink having high viscosity. In the method, the ink is warmed, and the warmed ink is jetted in a state where its viscosity has temporarily lowered.

SUMMARY

When an ink having a high viscosity is jetted using the above described liquid jetting head, it is conceivable for the ink to be warmed in order to temporarily lower the viscosity of the ink. When the warmed ink flows through the liquid channel of the channel substrate, heat of the warmed ink is transmitted to a joining portion of the wiring member and the channel substrate, via the channel substrate. Now, thermal expansion coefficients of the individual electrode terminals and the common electrode terminal differ from a thermal expansion coefficient of the adhesive joining the wiring member to the channel substrate. Therefore, there is a risk that when heat of the warmed ink is transmitted to the joining portion of the wiring member and the channel substrate, an internal stress is generated between the adhesive of the wiring member and the individual electrode terminals and common electrode terminal, and the wiring member is detached from the channel substrate.

The present teaching was made in view of such circumstances, and has an object of providing a liquid jetting head in which heat of warmed ink is hardly transmitted to a joining portion of a wiring member and a channel member, and an ink-jet printer including the liquid jetting head.

According to a first aspect of the present teaching, there is provided a liquid jetting head including: a nozzle plate having a nozzle surface in which nozzles are open; a channel member having a first surface and a second surface on an opposite side to the first surface, the nozzle plate being joined to the first surface, the channel member being formed with channels communicating with the nozzles respectively and a cavity being different from the channels, the channels including pressure chambers respectively; drive elements provided on the second surface of the channel member to correspond to the pressure chambers respectively, the drive elements having terminals led out to the second surface of the channel member; and a wiring member having wirings, the wirings being joined to the terminals respectively on the second surface of the channel member, wherein the nozzles are aligned in a first direction along the nozzle surface, the pressure chambers are aligned in the first direction, connecting points of the wirings and the terminals are aligned in the first direction, at least a part of the cavity is positioned between the pressure chambers and the connecting points, in relation to a second direction which is along the nozzle surface and orthogonal to the first direction, and the cavity has a length, in a third direction orthogonal to the nozzle surface, which is half or more of a thickness of the channel member in the third direction.

According to a second aspect of the present teaching, there is provided an ink-jet printer including: the liquid jetting head according to the first aspect of the present teaching; an ink supply unit configured to supply ink to the liquid jetting head; and a heater configured to heat the ink to be supplied to the liquid jetting head.

DESCRIPTION OF THE EMBODIMENTS

First Embodiment

Figure 1:
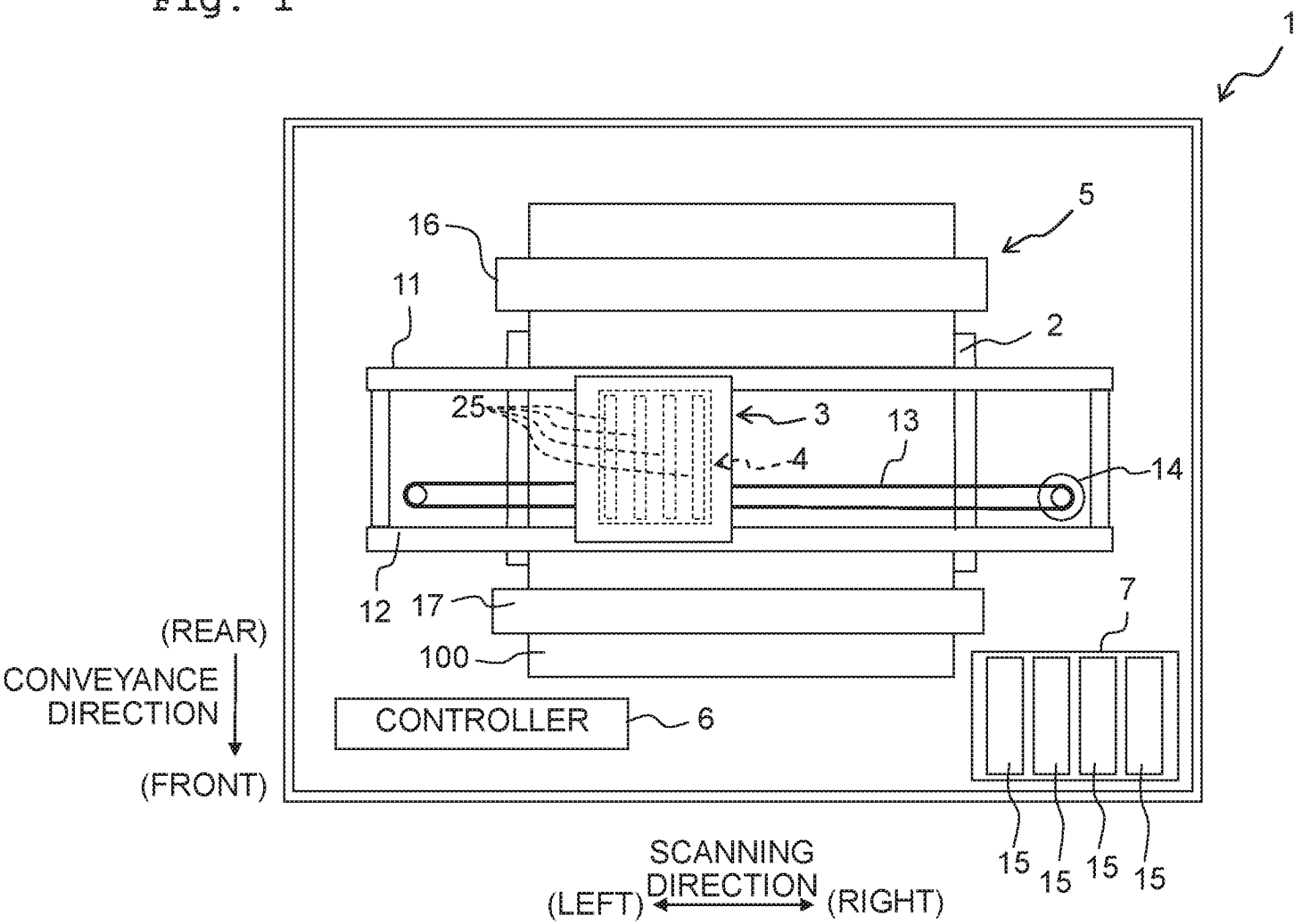
FIG. 1 is a schematic plan view of a printer according to a first embodiment.

A first embodiment of the present teaching will be described. First, a schematic configuration of an ink-jet printer 1 will be described with reference to FIG. 1. Note that each of directions of front, rear, left, and right depicted in FIG. 1 are defined as "front", "rear", "left", and "right" of the printer. Moreover, this side of the paper surface is defined as "up", and the far side of the paper surface is defined as "down". Hereafter, description will proceed making appropriate use of words for each of the directions of front, rear, left, right, up, and down.

<Schematic Configuration of Printer>

As depicted in FIG. 1, the ink-jet printer 1 mainly includes a platen 2, a carriage 3, an ink-jet head 4, a conveyance mechanism 5, and a controller 6.

A recording sheet 100 as a recording medium is placed on an upper surface of the platen 2. The carriage 3 is configured to reciprocate in a left-right direction (hereafter, also referred to a scanning direction) along two guide rails 11, 12 in a region facing the platen 2. An endless belt 13 is coupled to the carriage 3. The endless belt 13 is driven by a carriage drive motor 14, whereby the carriage 3 moves in the scanning direction.

The ink-jet head 4 is attached to the carriage 3, and moves in the scanning direction along with the carriage 3. The ink-jet head 4 includes four head units 25 aligned in the scanning direction. The four head units 25 are each connected by an unillustrated tube, to a cartridge holder 7 installed with four ink cartridges 15. The four ink cartridges 15 respectively store inks of four colors (black, yellow, cyan, magenta). Each of the head units 25 has nozzles 30 (refer to FIG. 2) formed on its lower surface (a surface on the far side of the paper surface of FIG. 1). The nozzle 30 of the head unit 25 jets toward the recording sheet 100 placed on the platen 2 one color of ink supplied from some one of the ink cartridges 15.

The conveyance mechanism 5 has two conveyance rollers 16, 17 that are disposed so as to sandwich the platen 2 in a front-rear direction. The conveyance mechanism 5 conveys the recording sheet 100 placed on the platen 2, in a frontward direction (hereafter, also referred to a conveyance direction), by the two conveyance rollers 16, 17.

The controller 6 includes the likes of a ROM (Read Only Memory), a RAM (Random Access Memory), and an ASIC (Application Specific Integrated Circuit) that includes various kinds of control circuits. The controller 6 executes various kinds of processing, such as printing, on the recording sheet 100, by the ASIC, according to a program stored in the ROM. For example, in a printing processing, the controller 6 controls the ink-jet head 4, the carriage drive motor 14, a conveyance motor (illustration of which is omitted) of the conveyance mechanism 5, and so on, to print an image or the like on the recording sheet 100, based on a printing instruction inputted from an external apparatus such as a PC. Specifically, the controller 6, while moving the ink-jet head 4 along with the carriage 3 in the scanning direction, causes alternate execution of an ink jetting operation in which ink is jetted from the nozzles 30 of the four head units 25 and a conveyance operation that conveys the recording sheet 100 a certain amount in the conveyance direction by the conveyance rollers 16, 17.

<Head Unit>

Next, a configuration of the head unit 25 will be described in detail. Note that the four head units 25 each have the same configuration, hence a description will be given below for one of the four head units 25.

Figure 2:
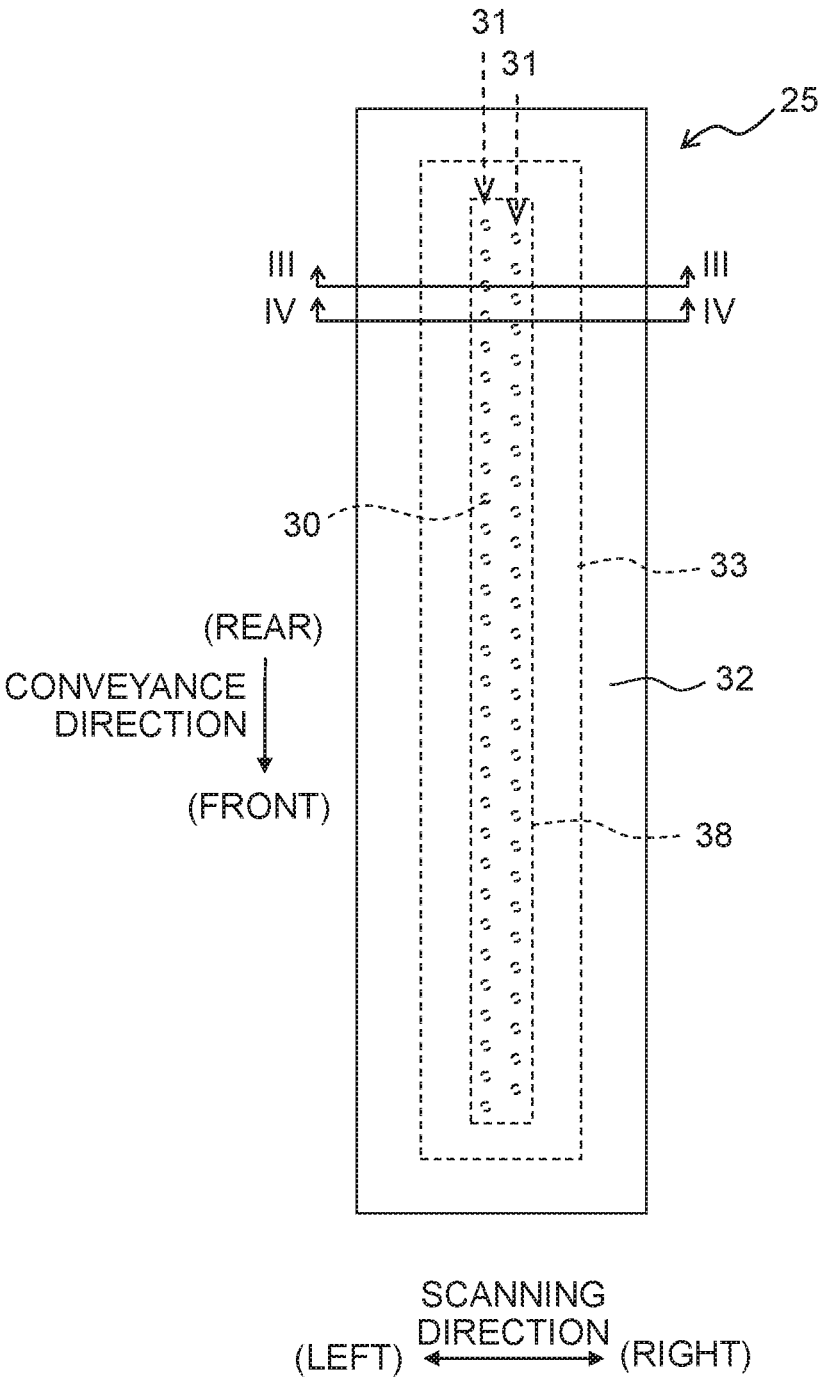
FIG. 2 is a plan view of a head unit according to the first embodiment.

As depicted in FIG. 2, the head unit 25 has an external shape which is long in the conveyance direction and substantially rectangular in planar view. Jetting ports of the nozzles 30 are formed in the lower surface of the head unit 25. In the description below, a region where the jetting ports of the nozzles 30 are formed, of the lower surface of the head unit 25, will be referred to as an ink jetting surface 25*a* (an example of a nozzle surface). In the ink jetting surface 25*a*, the nozzles 30 form two nozzle rows 31 arranged in the scanning direction. Each of the nozzle rows 31 extends in the conveyance direction.

Figure 3:
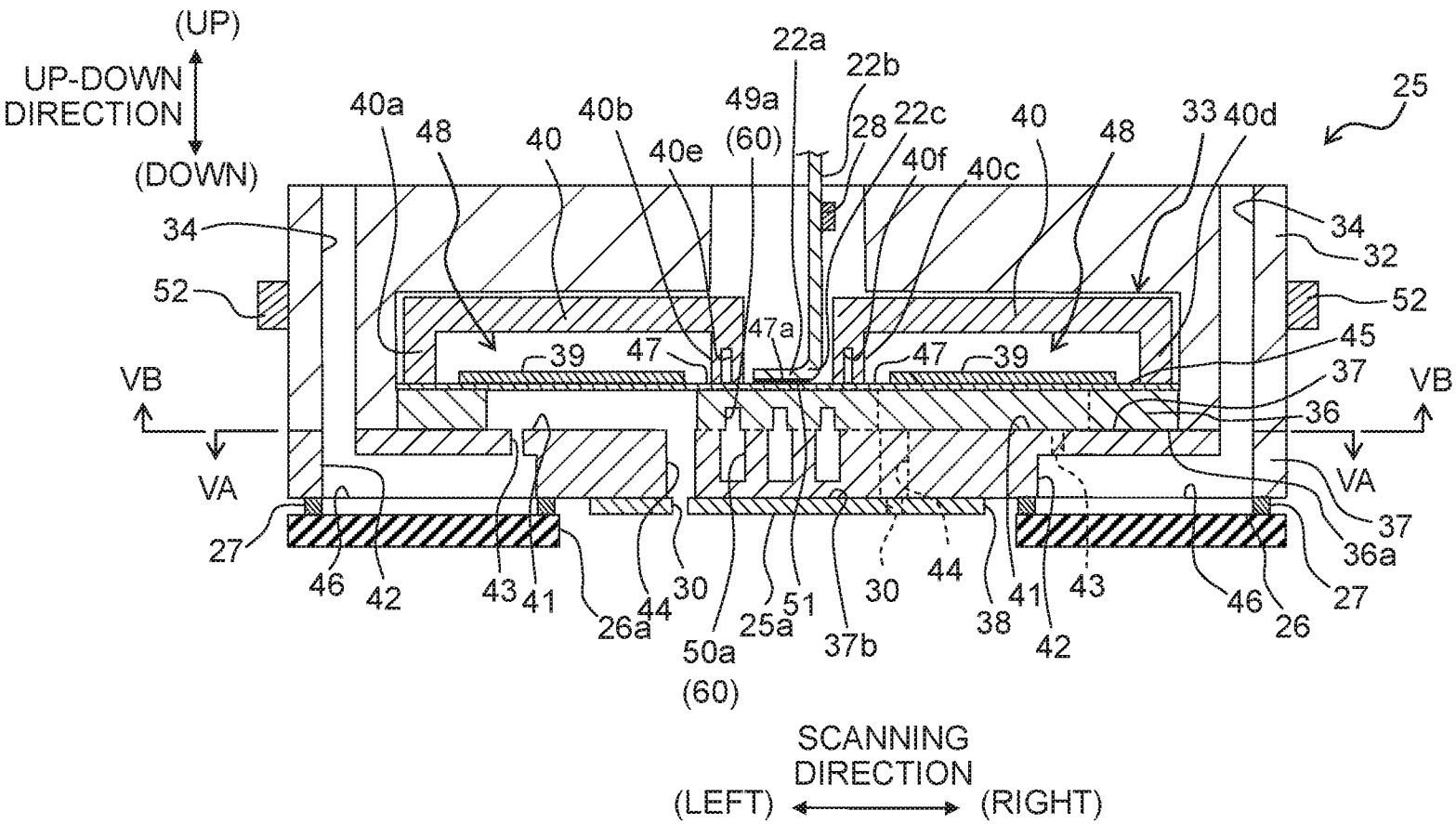
FIG. 3 is a cross-sectional view taken along the line of FIG. 2.
Figure 4:
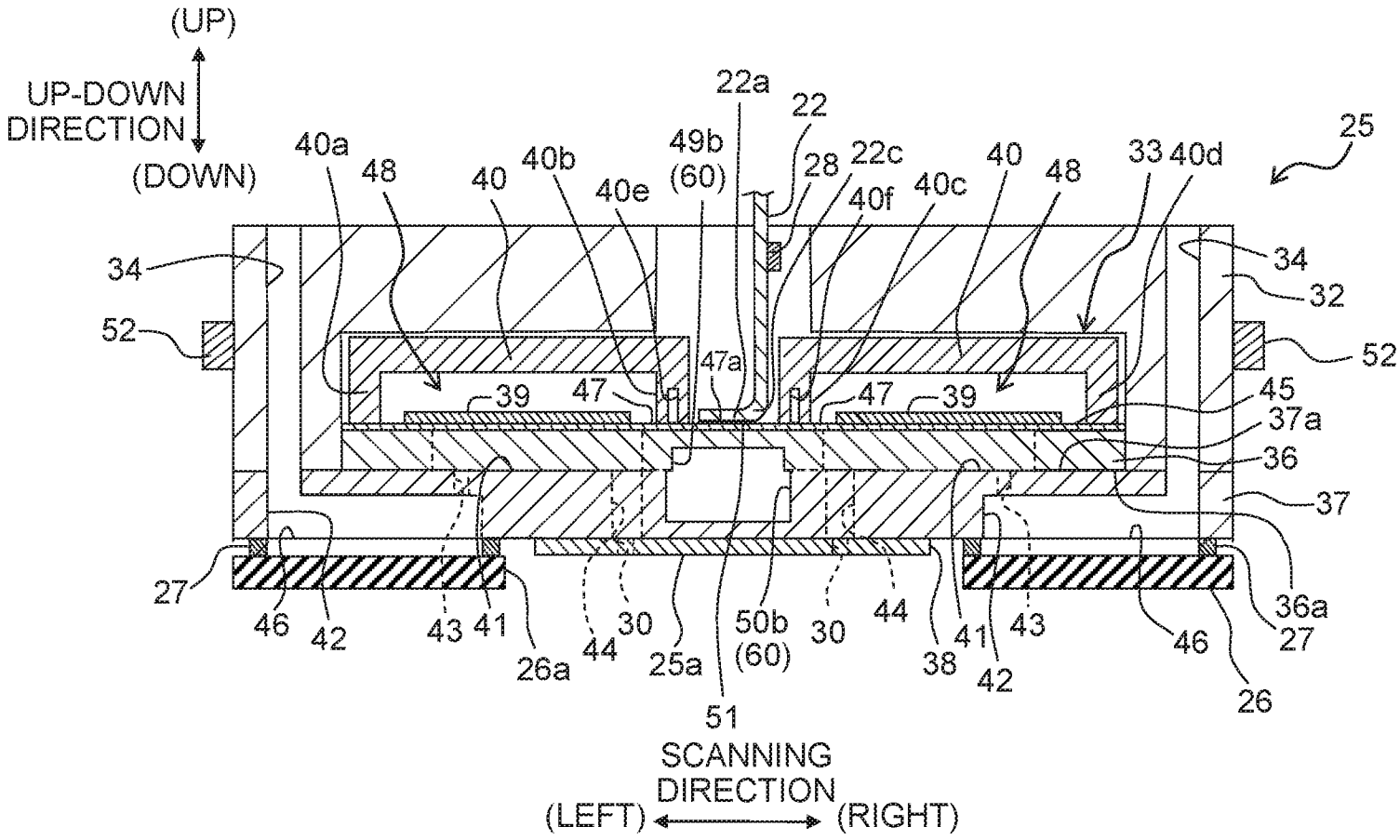
FIG. 4 is a cross-sectional view taken along the line IV-IV of FIG. 2.

As depicted in FIGS. 3 and 4, the head unit 25 includes a holder member 32 and a head main body 33 that is held in the holder member 32. Two ink channels 34 are formed in the holder member 32. The two ink channels 34 are each connected to some one of the four ink cartridges 15 (refer to FIG. 1) via the tube (illustration of which is omitted).

The head main body 33 includes a first channel substrate 36, a second channel substrate 37, a nozzle plate 38, piezoelectric elements 39 (an example of a drive element), a protective member 40, and so on.

The first channel substrate 36 is a silicon single crystal substrate. In the present embodiment, a thickness of the first channel substrate 36 is about 70 μm. The first channel substrate 36 has pressure chambers 41 formed therein to correspond to the nozzles 30 respectively. The pressure chambers 41 form two rows of the pressure chambers 41 arranged in the scanning direction. Each of the two rows of the pressure chambers 41 extends in the conveyance direction. Each of the pressure chambers 41 extends in the scanning direction and penetrates the first channel substrate 36 in an up-down direction.

Figure 5A:
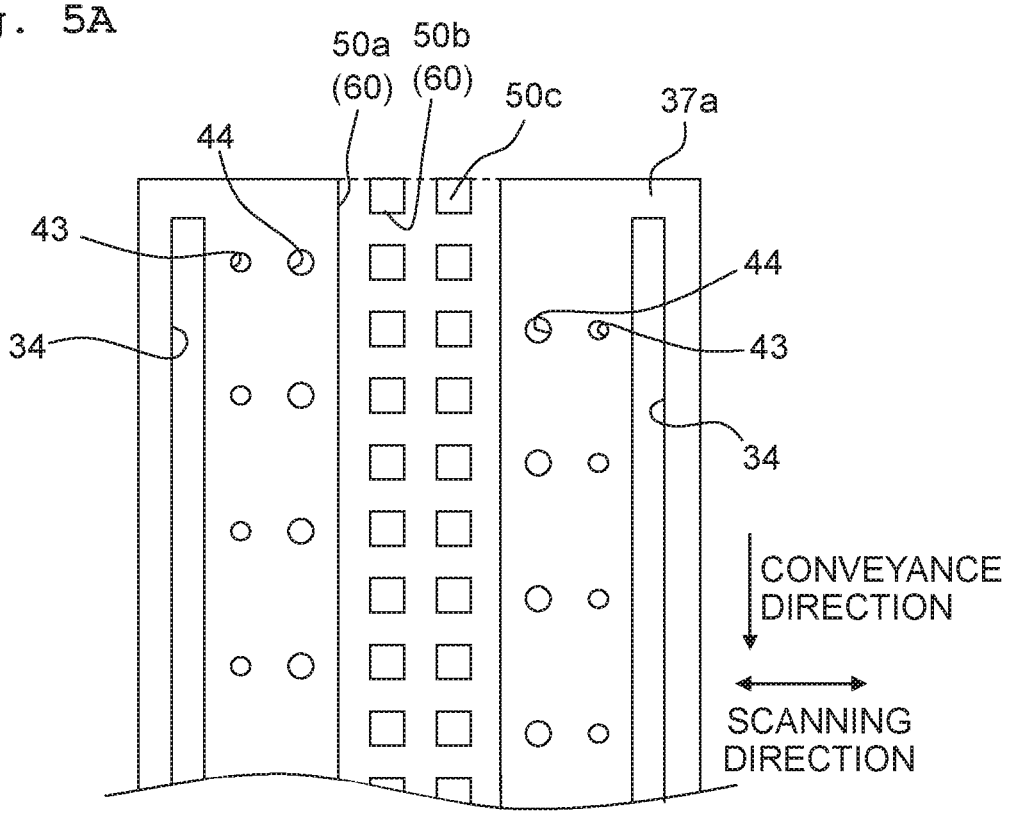
FIG. 5A is a cross-sectional view taken along the line VA-VA of FIG. 3.
Figure 5B:
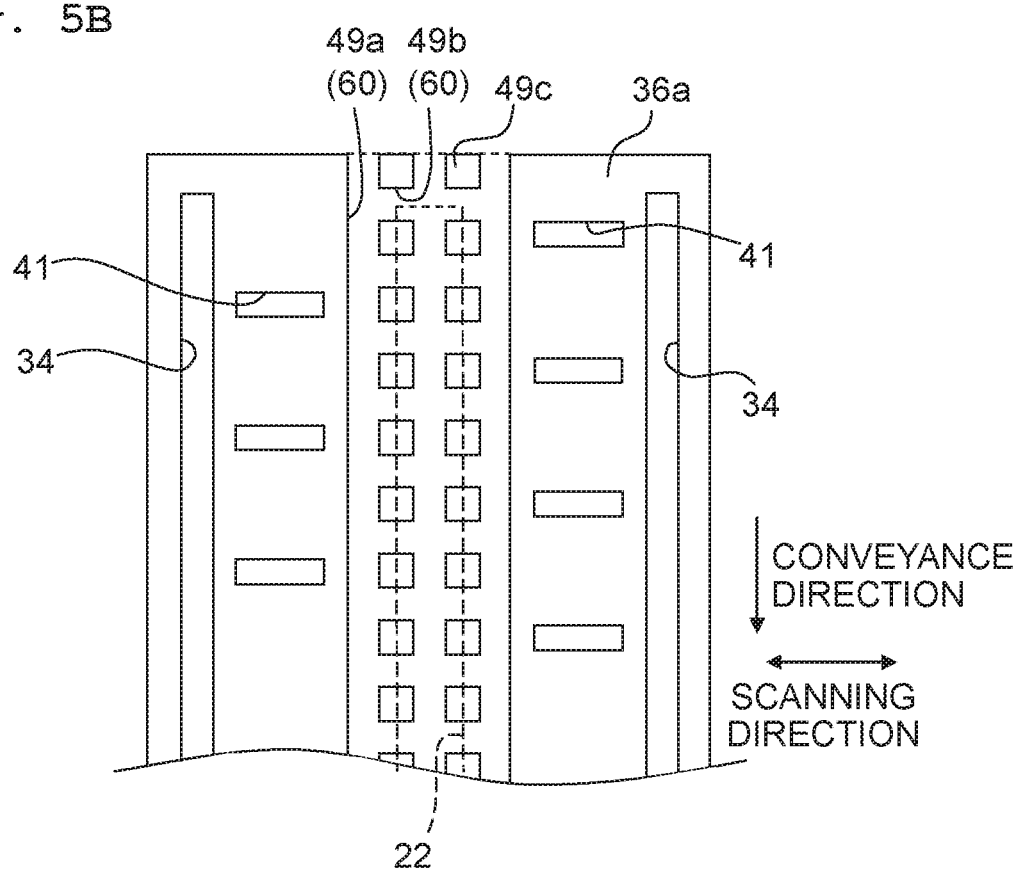
FIG. 5B is a cross-sectional view taken along the line VB-VB of FIG. 3.

As depicted in FIG. 5B, a lower surface 36*a* of the first channel substrate 36 has formed therein: three longitudinal grooves 49*a* (an example of a first cavity) each extending in the conveyance direction; and transverse grooves 49*b* each extending in the scanning direction. In the present embodiment, depths of the three longitudinal grooves 49*a* and the transverse grooves 49*b* are all about 40 μm. The three longitudinal grooves 49*a* each extend continuously from one end portion to the other end portion in the conveyance direction, of the first channel substrate 36. In other words, the three longitudinal grooves 49*a* are each open at both end portions in the conveyance direction of the first channel substrate 36. As depicted in FIGS. 4 and 5B, a left end of each of the transverse grooves 49*b* is positioned between the pressure chambers 41 positioned on the left and a left end (an end portion on an opposite side to a bent portion 22*c*) of a tip portion 22*a* of a COF 22, in relation to the scanning direction. On the other hand, a right end of each of the transverse grooves 49*b* is positioned between the pressure chambers 41 positioned on the right and a right end of the tip portion 22*a* (the bent portion 22*c*) of the COF 22, in relation to the scanning direction. The three longitudinal grooves 49*a* and the transverse grooves 49*b* intersect in a lattice shape. As a result, island portions 49*c* are formed in the lower surface 36*a* of the first channel substrate 36. The island portions 49*c* form two rows of the island portions 49*c* arranged in the scanning direction. Each of the two rows of the island portions 49*c* extends in the conveyance direction. The three longitudinal grooves 49*a* and transverse grooves 49*b* and the two rows of the island portions 49*c* are formed between the two rows of the pressure chambers 41, in relation to the scanning direction. Moreover, the first channel substrate 36 has a vibrating film 45 that covers the pressure chambers 41. The vibrating film 45 forms an upper surface (an example of a second surface) of the first channel substrate 36.

The second channel substrate 37 is a silicon single crystal substrate, and is joined to the lower surface 36*a* of the first channel substrate 36. In the present embodiment, a thickness of the second channel substrate 37 is about 400 μm. The second channel substrate 37 has formed therein two manifolds 42 that respectively communicate with the two ink channels 34 of the holder member 32. Ink of the ink cartridge 15 (refer to FIG. 1) is supplied to the manifold 42 via the tube and the ink channel 34 of the holder member 32.

Each of the two manifolds 42 extends in the conveyance direction (a direction perpendicular to the paper surface of FIG. 3) in a region overlapping in the up-down direction with the pressure chambers 41 of the first channel substrate 36. A lower end of each of the manifolds 42 is covered by a film 46 made of a synthetic resin. Moreover, a unit holding plate 26 that holds the head unit 25 is disposed, via a spacer 27, on a lower side of the film 46.

The second channel substrate 37 further has communicating holes 43 and descenders 44 formed therein. The communicating holes 43 communicate the manifolds 42 and the pressure chambers 41 respectively. The descenders 44 communicate the nozzles 30 formed in the nozzle plate 38 and the pressure chambers 41 respectively.

The descenders 44 form two rows of the descenders 44 arranged in the scanning direction. Each of the two rows of the descenders 44 extends in the conveyance direction. Each of the descenders 44 penetrates the second channel substrate 37 in the up-down direction.

As depicted in FIG. 5A, an upper surface 37*a* joined to the first channel substrate 36, of the second channel substrate 37 has formed therein: three longitudinal grooves 50*a* (an example of a second cavity) each extending in the conveyance direction; and transverse grooves 50*b* each extending in the scanning direction. In the present embodiment, depths of the three longitudinal grooves 50*a* and the transverse grooves 50*b* are all about 230 μm. The three longitudinal grooves 50*a* each extend continuously from one end portion to the other end portion in the conveyance direction, of the second channel substrate 37. In other words, the three longitudinal grooves 50*a* are each open at both end portions in the conveyance direction of the second channel substrate 37. A width in the scanning direction of each of the longitudinal grooves 50*a* is broader than a width in the scanning direction of each of the longitudinal grooves 49*a* of the first channel substrate 36. As depicted in FIGS. 4, 5A and 5B, a left end of each of the transverse grooves 50*b* is positioned between the descenders 44 positioned on the left and the left end (the end portion on an opposite side to the bent portion 22*c*) of the tip portion 22*a* of the COF 22, in relation to the scanning direction. On the other hand, a right end of each of the transverse grooves 50*b* is positioned between the descenders 44 positioned on the right and the bent portion 22*c* of the COF 22, in relation to the scanning direction. The three longitudinal grooves 50*a* and the transverse grooves 50*b* intersect in a lattice shape. As a result, island portions 50*c* are formed in the upper surface 37*a* of the second channel substrate 37. The island portions 50*c* form two rows of the island portions 50*c* arranged in the scanning direction. Each of the two rows of the island portions 50*c* extends in the conveyance direction. The three longitudinal grooves 50*a* and the transverse grooves 50*b* and the two rows of the island portions 50*c* are formed between the two rows of the descenders 44, in relation to the scanning direction.

Due to the first channel substrate 36 and the second channel substrate 37 being joined, the three longitudinal grooves 49*a* formed in the lower surface 36*a* of the first channel substrate 36 respectively overlap in the up-down direction with the three longitudinal grooves 50*a* formed in the upper surface 37*a* of the second channel substrate 37. Moreover, the transverse grooves 49*b* formed in the lower surface 36*a* of the first channel substrate 36 respectively overlap in the up-down direction with the transverse grooves 50*b* formed in the upper surface 37*a* of the second channel substrate 37. Furthermore, the island portion 49*c* of the first channel substrate 36 respectively overlap in the up-down direction with the island portions 50*c* of the second channel substrate 37. As a result, the first channel substrate 36 and the second channel substrate 37 have formed therein a cavity 60 that straddles the first channel substrate 36 and the second channel substrate 37 in the up-down direction and has a lattice shape intersecting in the conveyance direction and the scanning direction. Now, in consideration of strengths of the first channel substrate 36 and the second channel substrate 37, a length in the up-down direction of the cavity 60 must be made smaller than a sum of the thickness of the first channel substrate 36 and the thickness of the second channel substrate 37. On the other hand, from a viewpoint of a heat insulating effect, the length in the up-down direction of the cavity 60 is desirably half or more of the sum of the thickness of the first channel substrate 36 and the thickness of the second channel substrate 37. In the present embodiment, the length in the up-down direction of the cavity 60 is about 270 μm, in other words, is half or more of the sum (about 470 μm) of the thickness of the first channel substrate 36 (about 70 μm) and the thickness of the second channel substrate 37 (about 400 μm). A substrate formed by joining the first channel substrate 36 and the second channel substrate 37 is an example of a "channel member" of the present teaching.

The nozzle plate 38 is a plate formed by silicon, for example, and is joined to the lower surface 37*b* of the second channel substrate 37. The nozzles 30 arranged in the conveyance direction are formed in the nozzle plate 38. As mentioned above, the nozzles 30 form two nozzle rows 31 (refer to FIG. 2). Each of the nozzles 30 communicates with a corresponding pressure chamber 41 formed in the first channel substrate 36, via the descender 44 formed in the second channel substrate 37.

The piezoelectric elements 39 are disposed on an upper surface of the vibrating film 45 parallel to the ink jetting surface 25*a*, so as to respectively correspond to the pressure chambers 41. The piezoelectric elements 39 form two piezoelectric element rows 48 (refer to FIGS. 3 and 4) arranged in the scanning direction. Each of the piezoelectric element rows 48 extends in the conveyance direction. Each of the piezoelectric elements 39 vibrates the vibrating film 45 utilizing piezoelectric deformation when an applied voltage changes, and imparts jetting energy to ink within a corresponding pressure chamber 41, thereby discharging the ink from the nozzle 30. A drive wiring 47 for applying a certain drive voltage is connected to each of the piezoelectric elements 39. The drive wiring 47 is led out to a region between the two piezoelectric element rows 48, from each of the piezoelectric elements 39. An end portion on an opposite side to the piezoelectric element 39, of each of the drive wirings 47, is a drive contact 47*a* (an example of a terminal) to which the later-mentioned COF 22 is connected. The drive wirings 47 and the drive contacts 47*a* are aligned in the conveyance direction, in the region between the two piezoelectric element rows 48, of the upper surface of the vibrating film 45. The drive wirings 47 are formed by a metal such as gold (Au), for example.

Two protective members 40 respectively covering the two piezoelectric element rows 48 are adhered by an adhesive, to the upper surface of the vibrating film 45 of the first channel substrate 36. The two protective members 40 are provided for a purpose such as isolating the piezoelectric elements 39 from outside air and preventing them from coming into contact with moisture. The two protective members 40 are aligned in the scanning direction, and each extend in the conveyance direction. The protective member 40 on the left has two projections 40*a*, 40*b* (examples of a first projection and a second projection), and the protective member 40 on the right has two projections 40*c*, 40*d* (examples of a third projection and a fourth projection).

The two projections 40*a*, 40*b* of the left protective member 40 are aligned in the scanning direction, and each extend in the conveyance direction. Lower surfaces of the two projections 40*a*, 40*b* are adhered to the vibrating film 45 of the first channel substrate 36, whereby the left protective member 40 is adhered to the first channel substrate 36. As a result, the piezoelectric element row 48 on the left is covered by the left protective member 40. In other words, the left piezoelectric element row 48 is positioned between the projection 40*a* and the projection 40*b*, in relation to the scanning direction.

The two projections 40*c*, 40*d* of the right protective member 40 are aligned in the scanning direction, and each extend in the conveyance direction. Lower surfaces of the two projections 40*c*, 40*d* are adhered to the vibrating film 45 of the first channel substrate 36, whereby the right protective member 40 is adhered to the first channel substrate 36. As a result, the piezoelectric element row 48 on the right is covered by the right protective member 40. In other words, the right piezoelectric element row 48 is positioned between the projection 40*c* and the projection 40*d*, in relation to the scanning direction. Note that the lower surface of the projection 40*b* and the lower surface of the projection 40*c* may have respectively formed therein grooves 40*e*, 40*f* of a depth of about 100-200 μm that extend in the conveyance direction. In this case, not only can a heat insulating effect due to the grooves 40*e*, 40*f* be anticipated, but it is also possible for an adhesive material left over when the two protective members 40 are adhered by an adhesive to the first channel substrate 36, to be released to these grooves 40*e*, 40*f*.

<COF>

As depicted in FIGS. 3 and 4, the COF (Chip on Film) 22 as a wiring member having wirings, is joined to each of the head units 25. In more detail, the tip portion 22*a* (an example of a first portion) extending along the upper surface of the vibrating film 45, of the COF 22 is adhered by an adhesive 51 such as an anisotropic conductive film, for example, to the upper surface of the vibrating film 45, between the two left and right protective members 40. As a result, wirings of the COF 22 and the drive contacts 47*a* led out from the piezoelectric elements 39 are respectively electrically connected. Consequently, connecting points of the wirings and the drive contacts 47*a* are arranged in the conveyance direction between the two left and right protective members 40. In other words, the connecting points are positioned between the two pressure chamber rows 41, in relation to the scanning direction.

The COF 22 further includes: a led-out portion 22*b* (an example of a second portion) led out upwardly from the tip portion 22*a* adhered to the upper surface of the vibrating film 45; and the bent portion 22*c* between the tip portion 22*a* and the led-out portion 22*b*. A driver IC 28 connected to the wirings is mounted on the led-out portion 22*b*. Moreover, although illustration thereof is omitted, another end portion of the COF 22 is connected to the controller 6 of the ink-jet printer 1 (refer to FIG. 1). The driver IC 28 generates a drive signal for driving the piezoelectric elements 39, based on a control signal from the controller 6. The drive signal generated by the driver IC 28 is supplied to the piezoelectric elements 39, via the wirings of the COF 22 and the drive contacts 47*a*. The head unit 25 in a state that the COF 22 has been joined thereto, is an example of a liquid jetting head of the present teaching.

<Heater>

As depicted in FIGS. 3 and 4, a heater 52 extending in the conveyance direction is provided to each of both side surfaces in the scanning direction of the holder member 32. The heater 52 is provided to heat ink flowing through the ink channel 34 and lower a viscosity of the ink.

In the present embodiment, ink supplied to the head unit 25 from the ink cartridge 15 flows through the ink channel 34, the manifold 42, the pressure chamber 41, and the descender 44, before being jetted from the nozzle 30. Now, the ink is heated to lower its viscosity. Therefore, there is a possibility that when the heated ink flows through the pressure chamber 41 or the descender 44, heat of the ink is transmitted, via the first channel substrate 36 where the pressure chamber 41 is formed or the second channel substrate 37 where the descender 44 is formed, to the connecting points of the COF 22 and the drive contacts 47*a*. Now, a thermal expansion coefficient of the drive contacts 47*a* that are formed by a metal, and a thermal expansion coefficient of the COF 22 (in more detail, the adhesive 51 made of a resin by which the COF 22 is adhered to the first channel substrate 36) differ greatly. Specifically, whereas the thermal expansion coefficient of gold (Au) forming the drive contact 47*a* is about 14 ppm/° C., the thermal expansion coefficient of the adhesive 51 is about 30-100 ppm/° C., and a thermal expansion coefficient of a solder resist forming the COF 22 is about 100-200 ppm/° C. Therefore, there is a risk that when heat of the ink is transmitted to the connecting points of the COF 22 and the drive contacts 47*a*, an internal stress is generated between the COF 22 (in more detail, the adhesive 51) and the drive contacts 47*a*, and the COF 22 is detached from the first channel substrate 36.

In this regard, in the present embodiment, the first channel substrate 36 and the second channel substrate 37 have formed therein the cavity 60 of lattice shape intersecting in the scanning direction and the conveyance direction. In more detail, the cavity 60 is formed between the two rows of pressure chambers 41 and the two rows of the descenders 44, in relation to the scanning direction, and is formed to extend in the up-down direction across a boundary between the first channel substrate 36 and the second channel substrate 37. In other words, in relation to the scanning direction, at least a part of the cavity 60 is formed between one of the two rows of the pressure chambers 41 and the connecting points connecting the COF 22 and the drive contacts 47*a*, and is formed between one of the two rows of the descenders 44 and the connecting points connecting the COF 22 and the drive contacts 47*a*. Moreover, at least a part of the cavity 60 overlaps, in the up-down direction, with the connecting points connecting the tip portion 22*a* of the COF 22 and the drive contacts 47*a*. Furthermore, the tip portion 22*a* of the COF 22 is positioned between both ends in the scanning direction, of the cavity 60. Therefore, heat of the ink flowing through the pressure chamber 41 or the descender 44 is hardly transmitted to the connecting points between the COF 22 and the drive contacts 47*a*.

Moreover, in the present embodiment, due to the first channel substrate 36 and the second channel substrate 37 being joined, the island portions 49*c* of the lower surface 36*a* of the first channel substrate 36 and the island portions 50*c* of the upper surface 37*a* of the second channel substrate 37 are respectively joined. Therefore, a crack hardly occurs in the first channel substrate 36 and the second channel substrate 37 when the COF 22 is adhered to the first channel substrate 36, even supposing a load has been applied to the first channel substrate 36 and the second channel substrate 37.

In the present embodiment, all three of the longitudinal grooves 49*a* were open at both end portions in the conveyance direction of the first channel substrate 36, and all three of the longitudinal grooves 50*a* were open at both end portions in the conveyance direction of the second channel substrate 37. However, it is only required that at least one longitudinal groove 49*a* is open at both end portions in the conveyance direction of the first channel substrate 36, in other words, it is not required that all three of the longitudinal grooves 49*a* are open at both end portions in the conveyance direction of the first channel substrate 36. Moreover, at least one longitudinal groove 49*a* may be open at one end portion in the conveyance direction of the first channel substrate 36. Similarly, it is only required that at least one longitudinal groove 50*a* is open at both end portions in the conveyance direction of the second channel substrate 37, in other words, it is not required that all three of the longitudinal grooves 50*a* are open at both end portions in the conveyance direction of the second channel substrate 37. Moreover, at least one longitudinal groove 50*a* may be open at one end portion in the conveyance direction of the second channel substrate 37.

In the present embodiment, the three longitudinal grooves 49*a* and the transverse grooves 49*b* were formed in the lower surface 36*a* of the first channel substrate 36, and the three longitudinal grooves 50*a* and the transverse grooves 50*b* were formed in the upper surface 37*a* of the second channel substrate 37. However, only the three longitudinal grooves 49*a* and the transverse grooves 49*b* may be formed in the first channel substrate 36, or only the three longitudinal grooves 50*a* and the transverse grooves 50*b* may be formed in the second channel substrate 37. When only the three longitudinal grooves 49*a* and the transverse grooves 49*b* are formed in the first channel substrate 36, depths in the up-down direction of these grooves will desirably be half or more of the sum of the thickness of the first channel substrate 36 and the thickness of the second channel substrate 37. Similarly, when only the three longitudinal grooves 50*a* and the transverse grooves 50*b* are formed in the second channel substrate 37, depths in the up-down direction of these grooves will desirably be half or more of the thickness of the second channel substrate 37.

Although in the present embodiment, three of the longitudinal grooves 49*a* and three of the longitudinal grooves 50*a* were formed, one each or two each of the longitudinal grooves 49*a* and the longitudinal grooves 50*a* may be formed. Moreover, four or more each of the longitudinal grooves 49*a* and the longitudinal grooves 50*a* may be formed, provided they are formed between the two rows of the pressure chambers 41 and the two rows of the descenders 44, in relation to the scanning direction.

Second Embodiment

Next, a second embodiment of the present teaching will be described. A head unit 125 according to the second embodiment has a first channel substrate 136 and a second channel substrate 137 that differ from the first channel substrate 36 and the second channel substrate 37 of the head unit 25 according to the first embodiment. Therefore, the first channel substrate 136 and the second channel substrate 137 will be described below. Note that where something has a configuration similar to in the first embodiment, it will be described assigned with the same symbol as in the first embodiment.

Figure 6:
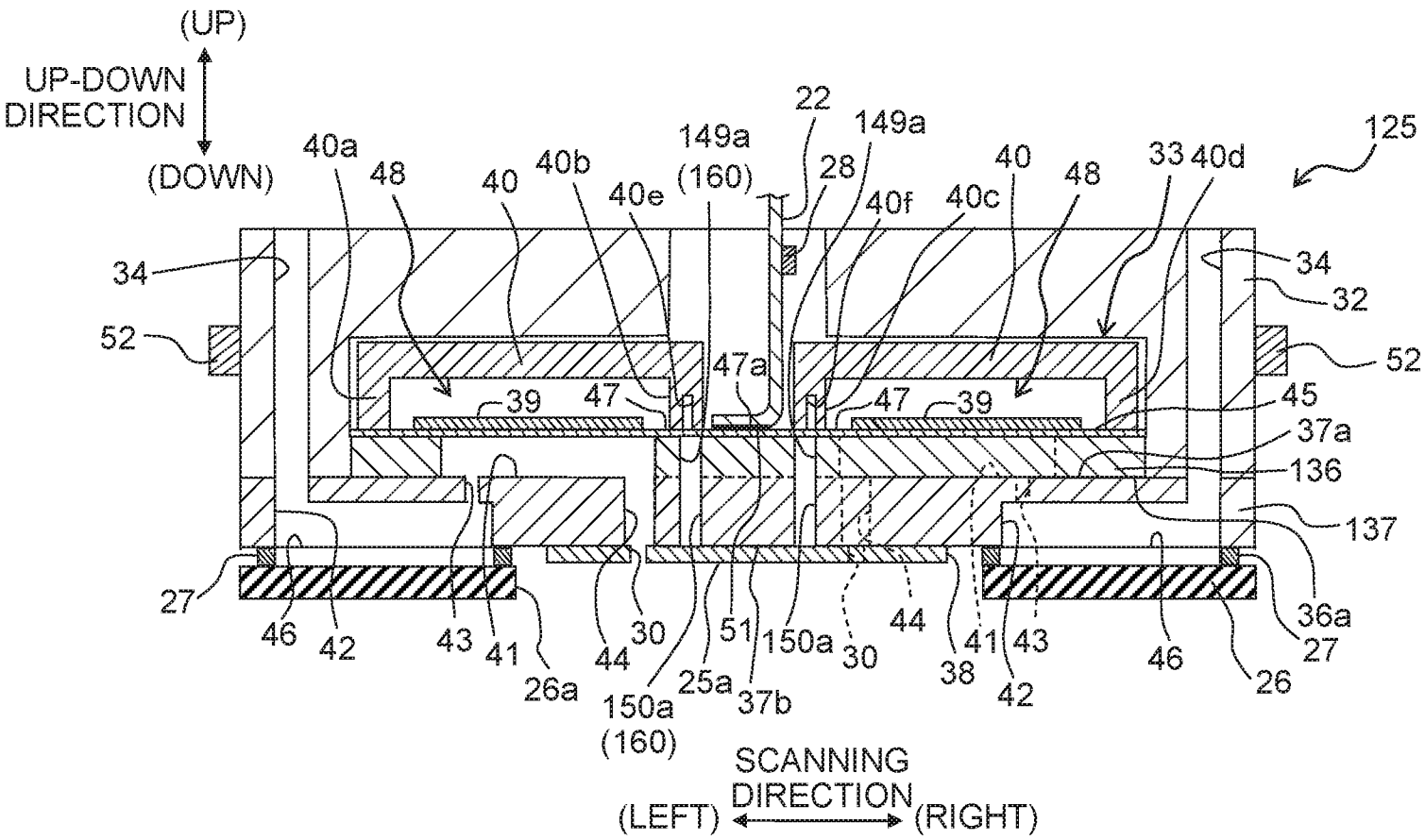
FIG. 6 is a view corresponding to FIG. 3, depicting a head unit according to a second embodiment.
Figure 7A:
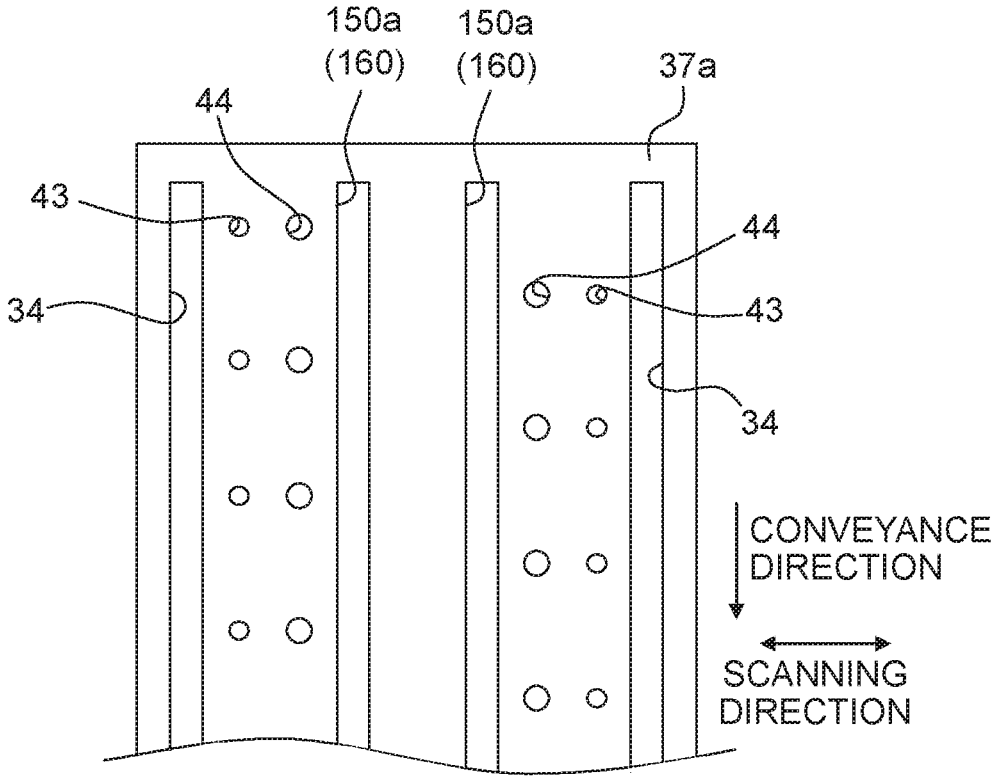
FIG. 7A is a view corresponding to FIG. 5A and depicting a second channel substrate according to the second embodiment.
Figure 7B:
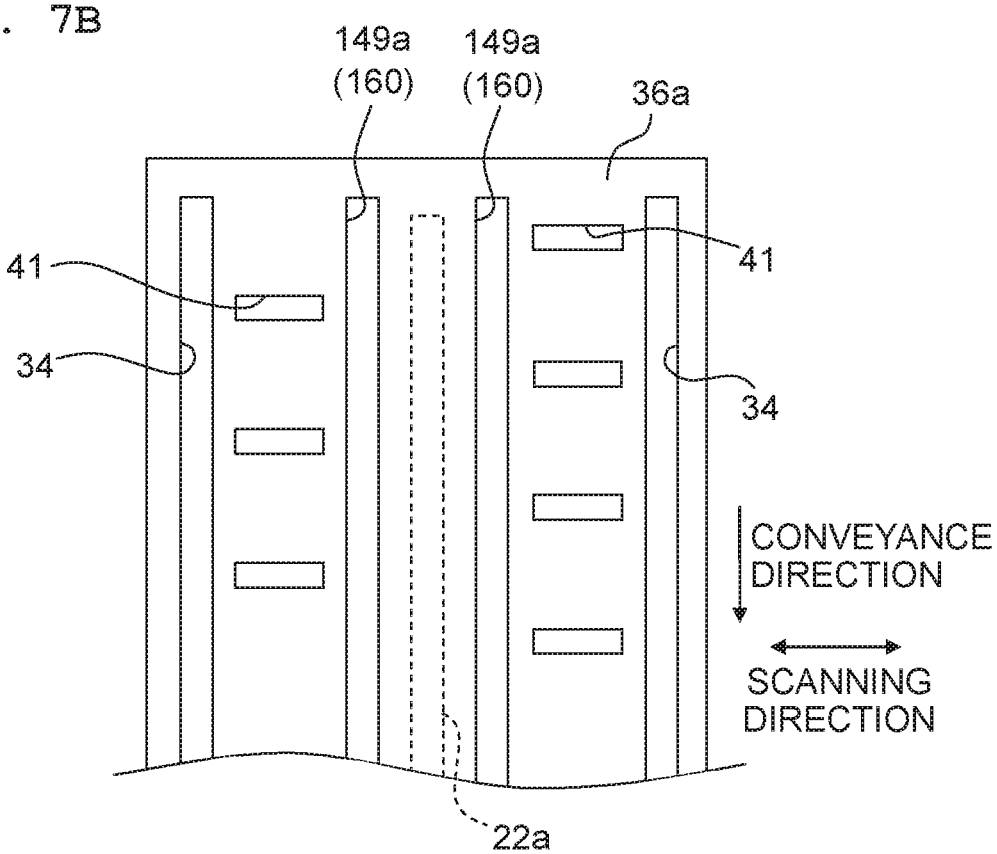
FIG. 7B is a view corresponding to FIG. 5B and depicting a first channel substrate according to the second embodiment.

In the present embodiment, as depicted in FIGS. 6 and 7B, two slits 149*a* each extending in the conveyance direction are formed between the two rows of pressure chambers 41, of the first channel substrate 136. The two slits 149*a* each penetrate the first channel substrate 136 in the up-down direction. In other words, a depth of each of the slits 149*a* is about 70 μm, the same as the thickness of the first channel substrate 136. Both ends in the conveyance direction of each of the slits 149*a* do not reach both ends in the conveyance direction of the first channel substrate 136. In the present embodiment, a length in the conveyance direction of each of the slits 149*a* is about 37 mm, which is shorter than a length in the conveyance direction of the first channel substrate 136 (about 40 mm). In contrast, both ends in the conveyance direction of the tip portion 22*a* of the COF 22 are positioned more inwardly than both ends in the conveyance direction of each of the slits 149*a*. In other words, the length in the conveyance direction of each of the slits 149*a* is longer than a length in the conveyance direction of the tip portion 22*a* of the COF 22 (about 35 mm). Therefore, the heat of the ink flowing through the pressure chamber 41 is hardly transmitted to the connecting points of the COF 22 and the drive contacts 47*a*. As depicted in FIG. 6, the slit 149*a* on the left is formed below the projection 40*b* on the right side in the left protective member 40, and the slit 149*a* on the right is formed below the projection 40*c* on the left side in the right protective member 40. In the present embodiment, a width in the scanning direction of each of the slits 149*a* is about 40 μm, and widths in the scanning direction of the projection 40*b* and the projection 40*c* are about 50-70 μm. In other words, the left slit 149*a* is covered by the projection 40*b* and has a width in the scanning direction which is narrower than that of the projection 40*b*. Similarly, the right slit 149*a* is covered by the projection 40*c* and has a width in the scanning direction which is narrower than that of the projection 40*c*.

As depicted in FIGS. 6 and 7A, two slits 150*a* each extending in the conveyance direction are formed between the two rows of the descenders 44, of the second channel substrate 137. The two slits 150*a* each penetrate the second channel substrate 137 in the up-down direction. In other words, a depth of each of the slits 150*a* is about 400 μm, the same as the thickness of the second channel substrate 137. Both ends in the conveyance direction of each of the slits 150*a* do not reach both ends in the conveyance direction of the second channel substrate 137. In the present embodiment, a length in the conveyance direction of each of the slits 150*a* is about 37 mm, which is shorter than a length in the conveyance direction of the second channel substrate 137 (about 40 mm). In contrast, both ends in the conveyance direction of the tip portion 22*a* of the COF 22 are positioned more inwardly than both ends in the conveyance direction of each of the slits 150*a*. In other words, the length in the conveyance direction of each of the slits 150*a* is longer than a length in the conveyance direction of the tip portion 22*a* of the COF 22 (about 35 mm). Therefore, the heat of the ink flowing through the descender 44 is hardly transmitted to the connecting points of the COF 22 and the drive contacts 47*a*. As depicted in FIG. 6, the slit 150*a* on the left overlaps in the up-down direction with the left slit 149*a* of the first channel substrate 136, and the slit 150*a* on the right overlaps in the up-down direction with the right slit 149*a* of the first channel substrate 136. In the present embodiment, a width in the scanning direction of each of the slits 150*a* is about 40 μm, which is the same as the width in the scanning direction of each of the slits 149*a*.

Moreover, due to the first channel substrate 136 and the second channel substrate 137 being joined, the two slits 149*a* formed to penetrate the first channel substrate 136 respectively overlap in the up-down direction with the two slits 150*a* formed to penetrate the second channel substrate 137. As a result, the first channel substrate 136 and the second channel substrate 137 have two cavities 160 formed therein. Each of the cavities 160 penetrates the first channel substrate 136 and the second channel substrate 137 in the up-down direction and extends in the conveyance direction.

In the present embodiment, the first channel substrate 136 and the second channel substrate 137 have the two cavities 160 formed therein. Each of the two cavities penetrates the first channel substrate 136 and the second channel substrate 137 in the up-down direction and extends in the conveyance direction. In more detail, in relation to the scanning direction, the cavity 160 on the left is formed between the left row of the pressure chambers 41 and the connecting points connecting the COF 22 and the drive contacts 47*a*, between the left row of the descenders 44 and the connecting points connecting the COF 22 and the drive contacts 47*a*. Moreover, in relation to the scanning direction, the cavity 160 on the right is formed between the right row of the pressure chambers 41 and the connecting points connecting the COF 22 and the drive contacts 47*a*, and between the right row of the descenders 44 and the connecting points connecting the COF 22 and the drive contacts 47*a*. Therefore, the heat of the ink flowing through the pressure chamber 41 or the descender 44 is hardly transmitted to the connecting points of the COF 22 and the drive contacts 47*a*.

In the present embodiment, the cavity 160 on the left overlaps in the up-down direction with the projection 40*b* on the right in the left protective member 40, and the cavity 160 on the right overlaps in the up-down direction with the projection 40*c* on the left in the right protective member 40. Therefore, transmission of heat from the protective member 40 to the connecting points of the COF 22 and the drive contacts 47*a*, can be efficiently prevented.

Note that although in the present embodiment, each of the cavities 160 was continuous in the conveyance direction, they may be divided at one or more places in the conveyance direction. When divided at one place, for example, they are desirably divided at a center portion in the conveyance direction.

Although in the above-described embodiments and modified examples thereof, air was present in the cavities 60, 160, the cavities 60, 160 may be filled with a heat insulating material having a thermal conductivity lower than that of the single crystal silicon forming the first channel substrates 36, 136 and the second channel substrates 37, 137. For example, calcium silicate which is porous and hardly transmits heat may be employed as such a heat insulating material. The thermal conductivity of calcium silicate is about 0.05-0.2 w/(m·k). Alternatively, the cavities 60, 160 may be in a vacuum state without being filled with anything.

Moreover, a planar shape of the cavities 60, 160 is not limited to being a lattice shape or a linear shape, and they may be formed in a saw tooth shape, for example.

Although in the above-described embodiments and modified examples thereof, the present teaching was applied to the ink-jet head which jets ink onto a recording sheet to print an image or the like, the present teaching may be applied also to a liquid jetting apparatus used in a variety of applications besides printing of an image or the like. For example, it is possible to apply the present teaching also to a liquid jetting apparatus that jets conductive liquid onto a substrate to form a conductive pattern on a substrate surface.

What is claimed is:

1. A liquid jetting head comprising:

a nozzle plate having a nozzle surface in which nozzles are open;

a channel member having a first surface and a second surface on an opposite side to the first surface, the nozzle plate being joined to the first surface, the channel member being formed with channels communicating with the nozzles respectively and a cavity being different from the channels, the channels including pressure chambers respectively;

drive elements provided on the second surface of the channel member to correspond to the pressure chambers respectively, the drive elements having terminals led out to the second surface of the channel member; and a wiring member having wirings, the wirings being joined to the terminals respectively on the second surface of the channel member, wherein the nozzles are aligned in a first direction along the nozzle surface, the pressure chambers are aligned in the first direction, connecting points of the wirings and the terminals are aligned in the first direction, at least a part of the cavity is positioned between the pressure chambers and the connecting points, in relation to a second direction which is along the nozzle surface and orthogonal to the first direction, and the cavity has a length, in a third direction orthogonal to the nozzle surface, which is half or more of a thickness of the channel member in the third direction.

2. The liquid jetting head according to claim 1, wherein the channels have descenders respectively, the descenders respectively communicating the pressure chambers and the nozzles, the channel member includes a first substrate formed with the pressure chambers and a second substrate formed with the descenders, the second substrate and the first substrate are laminated in this order in the third direction, and the cavity is formed to extend in the third direction across a boundary between the first substrate and the second substrate.

3. The liquid jetting head according to claim 2, wherein the cavity penetrates the first substrate and the second substrate in the third direction.

4. The liquid jetting head according to claim 2, wherein the cavity includes a first cavity formed in the first substrate and a second cavity formed in the second substrate, and in relation to the second direction, a width of the second cavity is larger than a width of the first cavity.

5. The liquid jetting head according to claim 1, wherein the wiring member includes: a first portion joined to the channel member; a second portion led out in a direction separating from the channel member; and a bent portion between the first portion and the second portion, the channels have descenders respectively, the descenders respectively communicating the pressure chambers and the nozzles, the channel member includes a first substrate formed with the pressure chambers and a second substrate formed with the descenders, the second substrate and the first substrate are laminated in this order in the third direction, the cavity is formed in the second substrate, and the first portion of the wiring member and the cavity overlap at least partially in the third direction.

6. The liquid jetting head according to claim 5, wherein the cavity is formed, in the second substrate, in a lattice shape intersecting in the first direction and the second direction.

7. The liquid jetting head according to claim 6, wherein the cavity is open at an end portion in the first direction of the second substrate.

8. The liquid jetting head according to claim 5, wherein the cavity extends, in the third direction, from a joining surface between the first substrate and the second substrate toward a joining surface between the nozzle plate and the second substrate, and the cavity has the length, in the third direction, which is half or more of a thickness of the second substrate in the third direction.

9. The liquid jetting head according to claim 5, wherein in relation to the second direction, the first portion of the wiring member is positioned between both ends of the cavity.

10. The liquid jetting head according to claim 5, wherein the cavity includes a first end and a second end in the second direction, the second end being more separated from the descenders than the first end is in relation to the second direction, and in relation to the second direction, the first end of the cavity is positioned between the descenders and an end portion, of the first portion of the wiring member, on an opposite side to the bent portion.

11. The liquid jetting head according to claim 1, wherein the pressure chambers form two pressure chamber rows arranged in the second direction and each extending in the first direction, and in relation to the second direction, the cavity and the connecting points are positioned between the two pressure chamber rows.

12. The liquid jetting head according to claim 11, wherein the cavity is formed as two cavities arranged in the second direction and each extending in the first direction.

13. The liquid jetting head according to claim 12, further comprising a cover joined to the channel member to cover the drive elements, wherein the cover includes a first projection, a second projection, a third projection, and a fourth projection each having a joining surface with the channel member, the first projection, the second projection, the third projection, and the fourth projection are arranged in the second direction in this order, each of the first projection, the second projection, the third projection, and the fourth projection extending in the first direction, the drive elements form a first drive element row and a second drive element row arranged in the second direction, each of the first drive element row and the second drive element row extending in the first direction, in relation to the second direction, the first drive element row is positioned between a first joining surface of the first projection with the channel member and a second joining surface of the second projection with the channel member, in relation to the second direction, the second drive element row is positioned between a third joining surface of the third projection with the channel member and a fourth joining surface of the fourth projection with the channel member, one of the two cavities at least partially overlaps with the second joining surface in the third direction, and the other of the two cavities at least partially overlaps with the third joining surface in the third direction.

14. The liquid jetting head according to claim 13, wherein each of the second joining surface and the third joining surface has a groove extending in the first direction.

15. The liquid jetting head according to claim 1, wherein the wiring member is electrically joined to the channel member via an adhesive.

16. The liquid jetting head according to claim 15, wherein the adhesive is an anisotropic conductive film.

17. The liquid jetting head according to claim 1, wherein the cavity is filled with a heat insulating material, and a thermal conductivity of the heat insulating material is lower than a thermal conductivity of a portion, of the channel member, where the channels and the cavity are not formed.

18. An ink-jet printer comprising:

the liquid jetting head as defined in claim 1;

an ink supply unit configured to supply ink to the liquid jetting head; and a heater configured to heat the ink to be supplied to the liquid jetting head.

* * * * *